US007018680B2

(12) United States Patent
Käsmä et al.

(10) Patent No.: US 7,018,680 B2
(45) Date of Patent: Mar. 28, 2006

(54) METHOD FOR SIMULTANEOUSLY POWDER COATING BOTH SURFACES OF A CONTINUOUS WEB

(75) Inventors: Veli Käsmä, Tampere (FI); Juha Maijala, Järvenpää (FI); Kaisa Putkisto, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/507,451

(22) PCT Filed: Mar. 11, 2003

(86) PCT No.: PCT/FI03/00181

§ 371 (c)(1),
(2), (4) Date: Feb. 22, 2005

(87) PCT Pub. No.: WO03/076716

PCT Pub. Date: Sep. 18, 2003

(65) Prior Publication Data

US 2005/0118348 A1 Jun. 2, 2005

(30) Foreign Application Priority Data

Mar. 14, 2002 (FI) ..... 20020479
Apr. 30, 2002 (FI) ..... 20020817

(51) Int. Cl.
*B05D 1/04* (2006.01)

(52) U.S. Cl. ..... 427/471; 427/479; 427/482; 427/485

(58) Field of Classification Search ..... 427/471, 427/479, 482, 475, 485, 361, 366, 371
See application file for complete search history.

(56) References Cited

U.S. PATENT DOCUMENTS

| | | | | |
|---|---|---|---|---|
| 3,380,845 | A | 4/1968 | Shapiro et al. | |
| 3,549,403 | A * | 12/1970 | Williams, Jr. et al. | 427/471 |
| 3,656,455 | A * | 4/1972 | Watanabe | 118/630 |
| 3,930,614 | A | 1/1976 | Krenkel | |
| 4,296,142 | A * | 10/1981 | Vasudevan et al. | 427/485 |
| 4,781,941 | A * | 11/1988 | Inukai et al. | 427/466 |
| 5,136,973 | A | 8/1992 | Nies et al. | |

(Continued)

FOREIGN PATENT DOCUMENTS

| | | | |
|---|---|---|---|
| EP | 0 782 934 | A1 | 7/1997 |
| EP | 0 982 120 | A1 | 3/2000 |
| FR | 1 436 020 | * | 3/1966 |
| FR | 1 436 020 | A | 4/1966 |
| WO | WO 98/11999 | A1 | 3/1998 |
| WO | WO 00/03092 | A1 | 1/2000 |
| WO | 00/14607 | * | 3/2000 |

OTHER PUBLICATIONS

Powder Coating: The Complete Finisher's Handbppk, Ed by N.P. Liberto, 1994, pp. 85-86.*
International Preliminary Examination Report issued in PCT/FI03/00181.

*Primary Examiner*—Fred J. Parker
(74) *Attorney, Agent, or Firm*—Stiennon & Stiennon

(57) ABSTRACT

A continuous web having a first surface and a second surface is coated with a coating powder by allowing the web to move between a first and a second electrode, which are in different potentials and are located on the opposite sides of the web, applying the coating powder on the surface of the web by utilizing the difference in the electric potential, and finishing the coated surface of the web. Both surfaces of the web are coated essentially simultaneously by using oppositely charged electrodes.

11 Claims, 1 Drawing Sheet

U.S. PATENT DOCUMENTS 5,474,871 A * 12/1995 Takagi et al. ..... 430/137.1
5,508,064 A * 4/1996 Naruse ..... 427/127
5,827,608 A * 10/1998 Rinehart et al. ..... 428/332
6,032,871 A 3/2000 Börner et al.
6,556,804 B1 * 4/2003 Löbel et al. ..... 399/306
2002/0114884 A1 * 8/2002 Friedersdorf et al. ..... 427/195

* cited by examiner

METHOD FOR SIMULTANEOUSLY POWDER COATING BOTH SURFACES OF A CONTINUOUS WEB

CROSS REFERENCES TO RELATED APPLICATIONS

This application is a U.S. national stage application of International Application No. PCT/FI03/00181, filed Mar. 11, 2003, and claims priority on Finnish Application No.20020479, filed Mar. 14, 2002, and on Finnish Application No. 20020817, filed Apr. 30, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for coating a surface of a continuous web having a first surface and a second surface with a coating powder. The method comprises: Allowing the web to move between electrodes which are in different potentials, applying the coating powder on the surface of the web by utilizing the difference in the electric potential, and finishing the coated surface of the web.

It is possible to treat the web by the dry surface treatment process by using a charging electrode and an earthing electrode on the opposite sides of the web. This principle is disclosed for example in EP 0982120, WO 98/11999 and Fl 105052 which corresponds to WO 00/03092 and EP 1099023.

If a double-sided treatment is required, the problem with treating only one side of the web at a time is that the coating powder has to be applied on the first surface of the web, and after that the first surface is finished for example by using heat and pressure. In the next process step, the same procedure is repeated to treat the second surface of the web.

SUMMARY OF THE INVENTION

The present invention is an improvement compared to the prior art. The method of the invention is characterized in that both surfaces of the web are coated essentially simultaneously by using oppositely charged electrodes. The term essentially means that a certain delay may be in the process, for example due to the path of the moving web.

General advantages related to the dry surface treatment process compared to conventional coated paper manufacturing processes are:

- The dry surface treatment process allows considerably lower investments compared to the conventional processes. The manufacturing line is substantially more compact. The conventional process can easily be replaced by the dry surface treatment process by rebuilding the old process, or the dry surface treatment process can be built on the place of the after-drying section which can be removed partly or entirely from a conventional layout, and
- The environmental aspects are also of importance. An eliminated water usage in the surface treatment process combined with a reduced or even eliminated water (e.g. a gas phase as dispersing medium) usage also during the coating component production are enormous advantages to the credit of the dry surface treatment process. Reduced energy consumption can also be achieved since water evaporation is eliminated and no after-drying section is needed (The coating powder is applied preferably at a moisture content of less than 15%).

By using the method of the invention, even more compact process line is achieved because some process steps can be avoided. Thus the process is simplified and shortened. The costs of the process are reduced.

DESCRIPTION OF THE PREFERRED EMBODIMENTS

Figure 1:
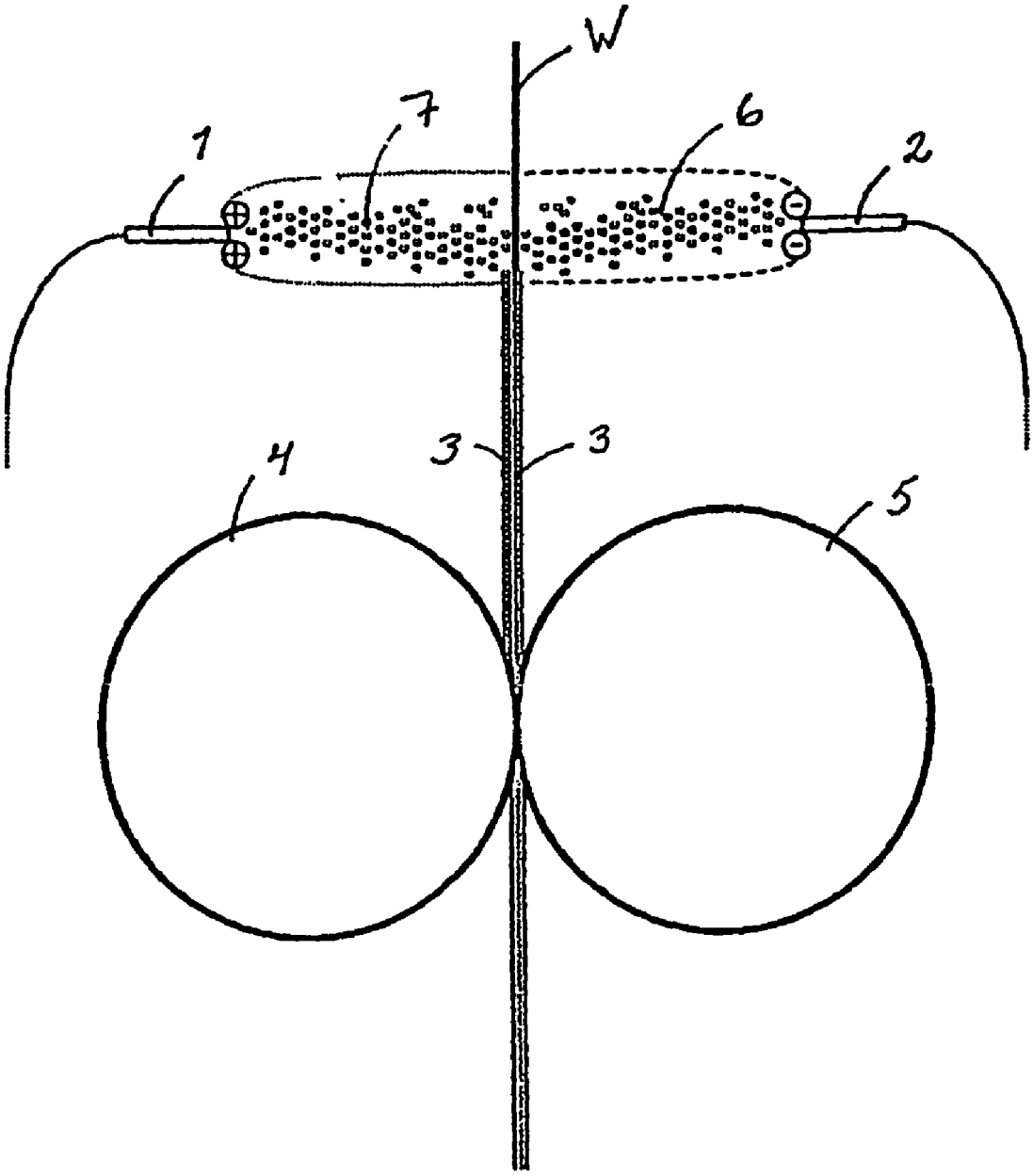
FIG. 1 is a schematic view of a dry surface treatment process according to the invention.

The dry surface treatment process of different substrates, such as paper or board substrates, comprises dry coating powder application followed by a finishing step, for example thermomechanical fixing. The application of the coating powder utilises an electric field to transfer the coating particles to the surface of the substrate and to enable an electrostatic adhesion prior to the finishing. Both the final adhesion and the surface smoothening of the coating are executed simultaneously through thermomechanical treatment or another suitable treatment.

When the both surfaces of the web are treated simultaneously, the web travels between two electrodes which are located on the opposite sides of the web and have opposite polarities. The charged particles of the coating powder are drawn by an electric field having an opposite sign. Thus the particles are placed on the surface of the web. If the first electrode is negative, the second electrode on the opposite side of the web is positive and vice versa. When the first corona charging electrode is negative, the particles of the coating powder charged by the generated negative ions move towards the positive corona charging electrode which is located on the other side of the web. The coating particles on the second side of the web are charged by positive ions generated by positive electrode and move towards the negative electrode. The difference in potentials of the two electric fields is considerable, and thus those two electrodes strengthen the function of each other. The shape of the electrodes can be chosen so that a concentration of charges and/or an electric breakdown are prevented. For example, wire-shaped electrodes which are located at some distance from the web parallel to the web are advantageous. Other possibilities for the electrodes include needle-like electrodes or plate electrodes. Instead of corona charging electrodes can also be used other electrodes suitable for creating a sufficient electric field to transfer charged coating particles.

In dry surface treatment of paper and paperboard, the powder is sprayed through an area of a strong electric field and high free-ion concentration to the surface of the substrate. The coating powder is put into the coating feeder chamber and transferred to the powder deposition unit with compressed air.

The coating powder is charged in the powder deposition unit. A primary requirement for electrostatic powder deposition is generation of large quantities of gas ions for charging the aerosol particles. This is accomplished by means of a gaseous discharge or corona treatment. The generation of a corona involves the acceleration of electrons to high velocity by an electric field. These electrons possess sufficient energy to release an electron from the outer electron shell when striking neutral gas molecules, thus producing a positive ion and an electron.

The powder is supplied to the application unit with compressed air or another transport medium that promotes particle charge. The transport medium can be added to the supply air e.g. through oxygen addition, or to entirely replace the supply air by another gas. Also the moisture content and the temperature of the supply air can be varied to improve the charging effect in the corona region. This might further improve the powder transfer in the electric field to the substrate surface. A higher temperature of the supply air increases the ionization coefficient. The supply air temperature should be kept under the polymer glass transition temperature ($T_{air}<T_g$ of the polymer) because otherwise the coating powder agglomerates. The moisture content of the supply medium must be kept below a relative humidity (RH) of 50% to avoid discharges and raise the medium pressure beyond 0.1 bar. Harmful discharges are prevented in this way.

Voltage and current are varied in relation to the required distance between the charging electrodes, the material properties (e.g. dielectric constants) of the electrodes, the powder composition (organic-inorganic ratio, dielectric constants of the powder etc.), the powder amount, the supply medium moisture content, and pressure. The voltage varies from 5 kV to 1000 kV and the current from 30 μA to 1000 A. The powder properties and the application concept guides partially the set-up of the charging electrodes.

The coating powder comprises either separate inorganic material particles and polymeric binder material particles or particles including both inorganic material and polymeric binder material (so-called hybrid particles). An average diameter of the material particles is chosen so that it is above of an average diameter of pores of a substrate to be coated. The average diameter of the material particles is usually 0.1–500 μm, preferably 1–15 μm. The coating powder usually comprises 10.1–99.5 wt-% (dry weight) of inorganic material and the rest is preferably polymeric binder material. The most common range for the amount of the inorganic material in the coating powder is 80–95 wt.-%. It is possible that the composition of the coating powders applied on the opposite surfaces of the web differ from each other.

The substrate to be treated is preferably a continuous web but the principle of the invention can also be applied to substrates in a sheet form. The substrate preferably comprises fibrous material but other substrates are also possible. The fibrous portion of the continuous web to be treated consists usually of papermaking fibres. In the present application, the papermaking fibres refer to fibres obtained from trees, in other words, either fibres of a mechanical or chemical pulp or mixtures of those two.

To strengthen the fastening of the coating powder to the web during the application of the dry coating powder it is advantageous to pre-treat the web. The pre-treatment may comprise rubbing, treating by corona, or moistening the web by suitable liquid substances, such as water, polyamide imide, hydrogen peroxide, or lime water. The fastening of the coating powder has different mechanisms, such as hydrogen bonds, oxidizing the surface of the web followed by forming of free radicals or a chemical reaction forming a new compound. The pre-treatment liquid is preferably sprayed from ducts in the form of fine fog particles towards the web to prevent excess moistening of the web.

The surface of the paper web to be coated may also be pre-treated by brushing. The fibres, which are located on the surface of the paper, are fibrillated to enhance the fixing of the coating powder on the web. The brushing has an effect on the web at least in three ways, namely enlarging the specific surface area, adjusting the roughness of the surface, and charging the surface by static electricity. The degree of fibrillation and the amount of static charging can be adjusted by adjusting the rotation speed and the pressing pressure of the brush. The desirable charge can be obtained by choosing the material of the brush accordingly. The brush may rotate clockwise or counterclockwise compared to the running direction of the web.

The application efficiency of the coating powder can be enhanced by directing the flow of the coating powder. Often the particles are blown substantially to the web direction. It is possible that some particles penetrate through the electric field without fastening to the web and cause dusting. When the application of the coating powder is made parallel to the direction of the electric field dusting is remarkably diminished. The parallel powder stream can also be used to overcome the air boundary layer. The coating powder can be pre-charged before creating the difference in the electric potential in the final stage between the surface of the substrate and the coating powder.

Some auxiliary substances can be sprayed simultaneously with the coating powder onto the web. They are preferably in a liquid form but also solids are used. The auxiliary substance is charged to have a similar charge as the coating powder and it is blown among the coating powder. The auxiliary substance may be for example water, lime water, cationic starch, polyvinylalcohol in a granular form or carboxymethylcellulose.

The dry coated substrate may also comprise more than one coating layer on the same side of the substrate. The layers can be different from each other. The charges, which are formed for the application of the coating powder, can be eliminated or changed to have a different sign after fixing the coating powder with heat and pressure. For example, when the first application is done by a negative charge to the first surface of the web, the second application can also be made by a negative charge to the first surface of the web, and hence the layers are adhered to each other properly due to the electric attraction.

In the case of an excess powder supply, the electrostatic deposition can be utilized to remove it. To remove an excess amount of the coating powder may be necessary for example when starting the process or changing production parameters. Secondary electrodes are used to accomplish the deposition. The coating powder has to be removed before its fixing on the web has been finalized. Before the fixing is finalized the particles of the coating powder are adhered to the web only by electric forces and hence they can be removed by using the secondary electrodes having an opposite charge compared to the particles of the coating powder. The removing of the coating powder can be enhanced e.g. by air doctoring. The powder collection can be done for example through electrostatic precipitation or air suction. The removing of the particles may-have prior treatments or local in situ treatments, which enhance the process. Also means for recycling may be used.

The application of the coating powder is followed by the finishing step. The preferred ranges for the thermomechanical treatment are: The temperature of 80–350° C., the linear load of 25–450 kN/m and the dwell time of 0.1–100 ms (speed 150–2500 m/min; nip length 3–1000 mm). The fixation can be reinforced in different ways to achieve desired paper properties. In this novel process solution, the polymer also creates physical adhesion of the coating layer to the paper surface, which replaces the lack of a penetration effect and mechanical interlocking present in a conventional process. The thermomechanical treatment can be made by various calendering methods or calendering-like methods. The methods utilize nips formed between rolls, or substantially long nips formed between two counter surfaces. Examples of such nips are hard-nip, soft-nip, long-nip (e.g. shoe-press or belt calender), Condebelt-type calender and super-calender.

An alternative to the heated roll is to use a suitable solvent to dissolve the binder, or a suitable radiation, for example IR radiation, to melt the binder. The wave length of the radiation is chosen so that the radiation does not absorb into the web but into the coating powder. After the radiation unit there can be a calender to give a sufficiently strong pressure treatment. The roll in contact with the coating layer can be either a resilient roll or a hard roll.

In the following, the invention will be described by means of an example and FIG. 1, which shows the principle of treating both sides of the web simultaneously.

FIG. 1 shows a dry surface treatment process according to the invention. A continuous web W is to be treated in such a way that a coating powder 6, 7 is supplied through an electric field formed between a first electrode 1 and a second electrode 2. The particles of the coating powder 7 have been charged positively due to the first positive electrode 1, and the particles of the coating powder 6 have been charged negatively due to the second negative electrode 2. The positively charged particles of the coating powder 7 are attracted by the negative electric field and by the negatively charged particles of the coating powder 6. Because the web W travels between the oppositely charged particles, the particles adhere to the web W by electric forces, thus creating a coating layer 3 to the both sides of the web W. The dry surface treatment process is finalized by finishing the web W by conveying it through a nip formed between two heated rolls 4, 5.

EXAMPLE

LWC paper was manufactured by a dry surface treatment process. The coating powder contained less than 10 wt.-% of a polymeric binder, namely styrene-butadiene copolymer (60/40 wt.-%). The glass transition temperature ($T_g$) of the polymeric binder was 20–40° C. The average diameter of the polymeric particles in a stable water-based dispersion was 0.15 μm. The inorganic portion of the coating powder consisted of 30 wt.-% of kaoline and 70 wt.-% of GCC ($CaCO_3$). The grain size distribution of the inorganic material was such that 90 wt.-% of the particles had the average diameter of less than 2 μm. The powder-based coating material was formed by a freeze-drying process followed by grinding.

The dry surface treatment process was executed in a speed of 1200 m/min. The coating powder was applied to the web direction at the both sides of the web by using pressurized air. An electric field was formed between a positive and negative electrode between which the web traveled. The coating powder was pre-charged before bringing it to the final electric field. The particles of the coating powder adhered to both sides of the web due to the electric forces, and thus a double-sided coating was achieved. The pressurized air was recycled back to the process.

The surface treatment of the web was finalized in a calender with hard rolls. The linear load was 150 kN/m and the temperature of the rolls was 200° C. The surface roughness of the hard-metal rolls was at least $R_a$<0.1 μm.

A dry surface treated paper having properties similar to the LWC paper was achieved.

The invention is not restricted to the description above, but the invention may vary within the scope of the claims.

The invention claimed is:

1. A method of coated paper manufacturing involving dry coating a surface of a continuous web of paper or paperboard, the method comprising the steps of:

moving the continuous paper or paperboard web having a first surface defining a first side and a second surface defining a second side, between a first electrode at a first potential located on the first side and spaced from the first surface and a second electrode at a second opposite potential, located on the second side and spaced from the second surface;

spraying a dry coating powder of 10.1–99.5 wt-% (dry weight) of inorganic material and 0.5–89.9 wt-% (dry weight) of a polymeric binder material on to the first surface of the paper or paperboard web to form a first coated surface, and on to the second surface of the paper or paperboard web to form a second coated surface, forming both the first and the second coated surfaces essentially simultaneously by utilizing the difference in the electric potential between the first potential and the second opposite potential; and finishing the first coated surface and the second surface by conveying the coated paper or paperboard web through a nip formed between two heated members.

2. The method of claim 1, wherein the two heated members are two heated rolls.

3. The method of claim 2, wherein the two heated rolls are metal rolls.

4. The method of claim 3, wherein the two heated rolls are metal rolls having a surface roughness of less than 0.1 μm.

5. The method of claim 2, wherein the two heated rolls have a temperature of 80–350° C.

6. The method of claim 1, wherein the first electrode and the second electrode are corona charging electrodes.

7. The method of claim 1, wherein the dry coating powder is pre-charged.

8. The method of claim 1, wherein the dry coating powder is applied on the web by supplying it in an electric field created by the first electrode and allowing an electric field created by the second electrode to draw particles of the dry coating powder on to the web.

9. The method of claim 1, wherein the dry coating powder is 80–95 wt.-% inorganic material.

10. The method of claim 1, wherein the dry coating powder is 80–95 wt.-% inorganic material, and 20–5 wt.-% polymeric binder material.

11. A method of coated paper manufacturing for dry coating a surface of a continuous web of paper or paperboard, the method comprising the steps of:

moving the continuous web of paper or paperboard having a first surface defining a first side and a second surface defining a second side, between a first electrode at a first potential located on the first side and spaced from the first surface and a second electrode at a second opposite potential, located on the second side and spaced from the second surface;

spraying a coating powder on to the first surface of the web of paper or paperboard to form a first coated surface, and on to the second surface of the web of paper or paperboard to form a second coated surface, forming both the first and the second coated surfaces essentially simultaneously by utilizing the difference in the electric potential between the first potential and the second opposite potential; and finishing the first coated surface and the second surface by conveying the coated web of paper or paperboard through a nip formed between two heated members;

wherein the first electrode and the second electrode are corona charging electrodes; and wherein the corona charging electrodes are wire-shaped electrodes which are positioned parallel to the web.

* * * * *